US006470642B1

(12) United States Patent
Eads

(10) Patent No.: US 6,470,642 B1
(45) Date of Patent: Oct. 29, 2002

(54) SELF-SEALING ROOF SHINGLE MOUNTING SYSTEM AND ATTACHMENT APPARATUS, AND METHOD OF USING SAME

(76) Inventor: Perry Lewis Eads, 3124 Willow St., Dearborn, MI (US) 48124

( * ) Notice: Subject to any disclaimer, the term of this patent is extended or adjusted under 35 U.S.C. 154(b) by 0 days.

(21) Appl. No.: 09/631,256

(22) Filed: Aug. 2, 2000

(51) Int. Cl.[7] ..... E04D 1/00

(52) U.S. Cl. ..... 52/518; 52/543; 52/546; 52/549

(58) Field of Search ..... 52/518, 520, 526, 52/546, 542, 545, 551, 553, DIG. 1, 746.11, 748.1, 127.5, 127.7, 749.12, 543, 544, 548, 549; 33/613, 533, 645, 649

(56) References Cited

U.S. PATENT DOCUMENTS

| | | | | | |
|---|---|---|---|---|---|
| 1,520,947 | A | | 12/1924 | Harris | |
| 1,684,179 | A | | 9/1928 | Griswold | |
| 2,045,707 | A | | 6/1936 | Hammersley | |
| 4,541,217 | A | * | 9/1985 | Stewart | 52/518 |
| 5,012,623 | A | | 5/1991 | Taylor | |
| 5,050,357 | A | | 9/1991 | Lawson | |
| 5,622,020 | A | | 4/1997 | Wood | |
| 5,623,802 | A | * | 4/1997 | Boushek et al. | 52/543 |
| 5,642,596 | A | * | 7/1997 | Waddington | 52/546 |
| 5,671,577 | A | | 9/1997 | Todd | |
| 5,784,848 | A | | 7/1998 | Toscano | |
| 5,956,913 | A | | 9/1999 | Nicholson | |
| 6,052,961 | A | * | 4/2000 | Gibbs | 52/518 |
| 6,109,765 | A | * | 8/2000 | Blanton | 362/250 |

* cited by examiner

*Primary Examiner*—Carl D. Friedman
*Assistant Examiner*—Jennifer I. Thissell
(74) *Attorney, Agent, or Firm*—Carrier, Blackman & Associates, P.C.; Joseph P. Carrier; William D. Blackman

(57) ABSTRACT

A shingle mounting system includes a plurality of securing strips for detachably securing shingles to a roof surface. Each securing strip includes a base portion, a folding edge, and plural projecting members attached to the base. Each shingle has a line of perforations formed through an upper edge thereof. Shingles are attached to the securing strip by placing the projecting members through the holes in the shingles, and folding the folding edge of the securing strip over the base portion. A roofing kit according to the invention includes shingles, securing strips, and at least two adjustable spacer tools. Each of the tools includes two channeled pieces that are slidably nested one inside another, and which may be locked in relative position via a locknut assembly. The tool operates to measure spaced placement of the next securing strip, eliminating the need to hand measure spacing of each succeeding shingle row.

20 Claims, 3 Drawing Sheets

SELF-SEALING ROOF SHINGLE MOUNTING SYSTEM AND ATTACHMENT APPARATUS, AND METHOD OF USING SAME

BACKGROUND OF THE INVENTION

1. Field of the Invention

The present invention relates to a system for attaching roofing shingles to a flat roof surface. More particularly, the present invention relates to a system and apparatus for facilitating simplified, accurate installation of asphalt roofing shingles to a surface, and for permitting simplified replacement of selected shingles so installed.

2. Description of the Background Art

The roof is a critical part of any building that must be maintained and eventually replaced either in part or in whole. However, the conventional systems and methods for attaching traditional asphalt shingles to a roof is not conducive to simple and economical replacement of individual shingles. The conventional methods for attaching shingles to a roof involve starting at the bottom of the roof and moving up towards the apex of the roof, overlapping and nailing each row of shingles over the previous row.

One significant problem with conventional methods is that they do not allow replacement of just a few shingles, which may become damaged from time to time, although the roof in general remains in good condition. Instead, typically entire sections of shingles, from the apex of the roof down to the shingle being replaced must be removed. This process is quite inefficient, requiring a considerable amount of time and materials just to replace a few bad shingles.

Another problem with conventional methods is that the act of nailing shingles to the roof, each time shingles are replaced, creates numerous holes in the roof of the building, and also uses a lot of fasteners such as nails, staples, etc. During the conventional process of replacing. shingles, many un-filled holes are created as old shingles are torn up and then new shingles are nailed back down again. These un-filled holes often create problems, in terms of water leakage, deteriorated strength of roof boards, etc.

Still another problem is that asphalt shingles create excessive and unnecessary waste in landfills. Although attempts have been made to recycle the shingles, the process is not very efficient, as foreign materials, such as the nails, staples, etc. used to attach the singles to a roof, must be removed before the shingles can be recycled. The removal of these foreign objects incurs substantial extra costs and frustrates the recycling process, as a practical matter.

A limited number of alternative shingling systems are known. For example, Nicholson, U.S. Pat. Nos. 5,956,913 and 5,685,117, disclose a self-sealing roof shingle mounting system that includes a shingle attachment strip and shingles. The attachment strip forms a U-shaped clip and is attached to the roof such that the clip opening faces the roof apex. The strip further includes a gasket formed from weather resistant sealing material. The shingles are preferably metal, with the upper edge on each shingle forming an inverted U-shaped clip. A shingle is attached by slidably interconnecting the shingle clip with that of an attachment strip.

Toscano, U.S. Pat. No. 5,784,848, discloses a roofing system and shingle that includes one attachment strip per roof section connected to the roof near the apex. The top row of shingles attaches to the strip, and subsequent rows attach to the previous row of shingles by means of flanges attached to the bottom edge of the previous row of shingles. Each shingle interconnects on its sides with adjacent shingles, and each shingle is also nailed or otherwise attached to the roof. The shingles are also preferably made from aluminum or another lightweight metal.

Although these patented systems provide some benefits, they also have special disadvantages associated therewith. For example, these systems require special components, namely the metal shingles, instead of utilizing readily available common-place materials. Also, none of the other systems specifically address all the problems of conventional methods, as discussed above. For example, the Toscano system still requires the nailing down of new shingles each time the shingles are replaced, which results in many problematic unfilled holes in the roof, as explained above. In addition, the other systems do not adequately provide for simple installation of shingles and simple replacement of individual shingles or isolated groups of shingles, without incurring extra cost and waste. Furthermore, none of the other systems improve the recycling process of the waste that is created. Therefore, many of the problems of conventional methods discussed above still remain.

As will be understood, a need still exists in the art for an improved roofing system using asphalt shingles, that overcomes the above problems. Furthermore, the roofing system should be relatively simple to install initially, simple and efficient for allowing replacement of individual shingles from time to time, and inexpensive to manufacture.

SUMMARY OF THE INVENTION

The present invention provides a shingle mounting system to allow a user thereof to install and replace asphalt roofing shingles. A shingle mounting system in accordance with the present invention, generally, includes asphalt shingles and securing strips for securing and removing shingles on a roof. The present invention further provides a kit including shingles, securing strips, and at least two adjustable spacer tools.

The asphalt shingles, according to the invention, are identical to one another and include spaced holes at the top of the shingle to enable attachment to the securing strips. The securing strips, which are preferably aluminum or plastic, are identical and are provided for attaching shingles to a roof surface. The securing strips include a base portion and a folding edge. A bight is provided at the back of the securing strip to interconnect the folding edge and the base portion, and to allow enough space therebetween to accept a shingle. The folding edge is pivotally attached to the top of the bight, and is foldable relative to the base portion of the strip.

The securing strips further include multiple projecting members, attached either to the upper surface of the base portion or to the lower surface of the folding edge. In a preferred embodiment of the invention, each of the projecting members includes a pin, and an offset end cap attached to a free end of the pin. The end cap is larger in diameter than the pin, forming a lip. This lip serves to retain the shingle in place on the securing strip, as the hole in the shingle is dimensioned to allow easy manipulation of the shingle over the end cap onto the pin, yet to restrict the shingle from coming off the pin easily. The folding edge is then folded over the shingle edge to releasably lock the shingle to the securing strip.

The shingle mounting system according to the invention reduces the need for extraneous fasteners such as conventional nails or staples. Reducing the number of nails of staples needed to secure each shingle to the roof is advantageous in many ways. One advantage is that replacing one shingle or a group of shingles is made simple, since only those shingles to be replaced need to be removed from the roof. Reducing the needed number of nails or staples also decreases the number of unfilled holes in the roof. Additionally, the number of nails used on a roof is decreased by as much as two-thirds since only the securing strips are nailed to the roof. Moreover, costs are cut by increasing the efficiency of recycling asphalt shingles, as fewer foreign materials such as nails, staples, etc. need to be sorted out during the recycling process. As a result, roofing manufacturers will purchase less raw materials, thereby reducing the amount of petroleum products purchased and depleted from the Earth's natural resources. Finally, this system can be used with materials that are readily available, after a minor modification of such materials, which will make production of the needed pieces fast, easy, and economical.

The present invention also contemplates a kit for attaching shingles to a roof surface, which includes securing strips, shingles, and at least two securing strip adjustable spacer tools. The adjustable spacer tools are primarily made of two telescoping channeled pieces nested together, which are an inside piece and an outside piece.

The outside piece has a radius slot at one end thereof, to allow attachment of the tool to a securing strip at one of the strip's projecting members. The outside piece also has a hole formed through a side wall thereof, in the end of the piece opposite the radius slot, to accept a fastener therethrough for attaching it to the inside piece.

The inside piece includes a nut assembly that slides along the length of the tool. This inside piece fits inside the outside piece and connects thereto via the nut assembly. The effective length of the tool may be adjusted by loosening the nut assembly, and then sliding the inside piece relative to the outside piece. This adjustable length permits the tool to be adapted to be used with different sizes of shingles.

In a conventional installation, the placement of each row of shingles must be hand measured, to ensure that the row is properly spaced and parallel to the previous row.

By contrast, using the adjustable spacer tools and shingle mounting system according to the present invention, only the placement of the securing strip for the first row needs to be measured. After the first row, the tools are used to place the remaining securing strips.

These tools make initial shingle installation simple and accurate.

Furthermore, these measuring tools are re-usable and adjustable in length to accommodate different sizes and brands of shingles.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF THE PREFERRED EMBODIMENT

Overview

Figure 1:
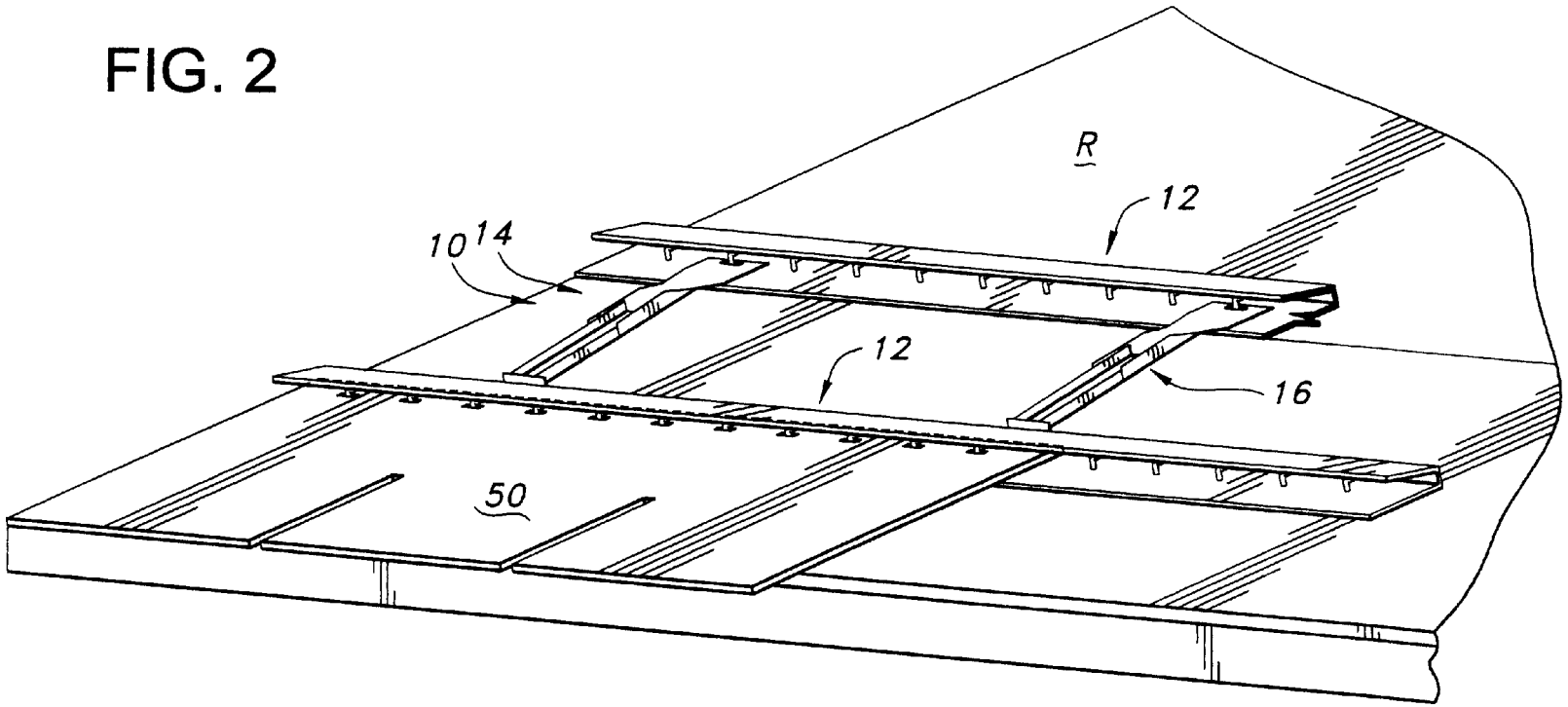
FIG. 1 is a cut away perspective view of a portion of a roof on a building structure, showing a shingle mounting system according to the present invention in use to install shingles thereon.

Referring now to FIG. 1 of the drawings, a generally planar portion of a roof R on a building is shown cut away, with a first shingle 50 being installed thereon, using a mounting system 10 and method according to the present invention.

Figure 2:
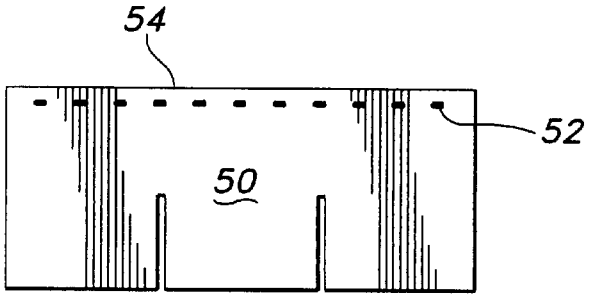
FIG. 2 is a top plan view of a shingle which has been modified to work with the shingle mounting system according to the present invention.

The shingle 50 is an asphalt shingle, and is substantially identical to conventional, known asphalt shingles of which are commercially available in home improvement stores, in the standard dimensions, except that in order to be used with the system 10 according to the invention, as shown in FIG. 2, the shingle 50 has been modified by having a linear series of parallel perforations 52 formed therethrough, a short distance below the upper edge 54 thereof.

The system 10 according to the present invention includes a multiplicity of substantially identical securing strips 12, and a pair of substantially identical adjustable spacer tools 14, 16 for use in properly spacing apart adjacent shingles 50. For purposes of simplicity of explanation, the adjustable spacer tool 14 may be simply referred to in abbreviated fashion as a tool 14 herein. The system 10 may further include a plurality of shingles 50 of the type illustrated in FIG. 2 and including the perforations 52 formed therethrough. Each of these components of the system 10 will be discussed in further detail herein.

The Securing Strips

The securing strips 12 are generally thin, elongated pieces of mounting material, for use in attaching shingles 50 to a roof R. The securing strips may be made of aluminum or a strong plastic material. Each securing strip 12 includes an internal hinge 13, and where the securing strips are made of plastic, this may be a 'living hinge', formed from a thin section of the plastic. The securing strips 12 may be provided as pre-cut strips, or alternatively, may be cut to length to fit a particular application on a job site, from a prefabricated roll of securing strip material.

The securing strips 12 are installed substantially horizontally and parallel to one another on the roof R, in a manner to be further detailed below. The securing strips 12 are also installed substantially parallel to the outermost lower edge of the roof R. The shingles 50 are mounted to the securing strips, rather than being nailed directly on to the surface of the roof R in conventional fashion.

Figure 4:
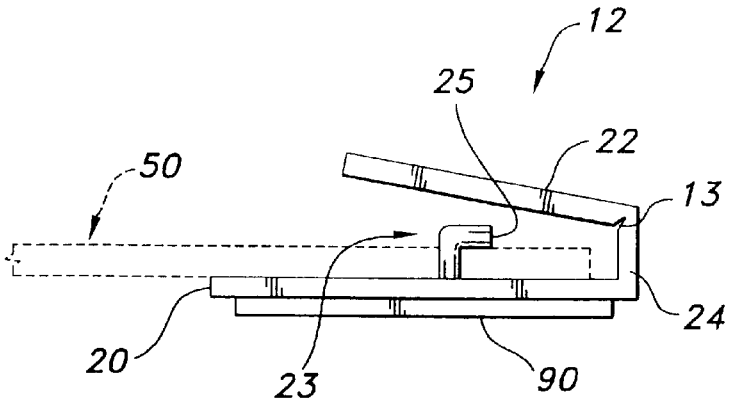
FIG. 4 is a side elevational view of the securing strip of FIG. 3, showing a shingle in phantom therein in accordance with the present invention.
Figure 3:
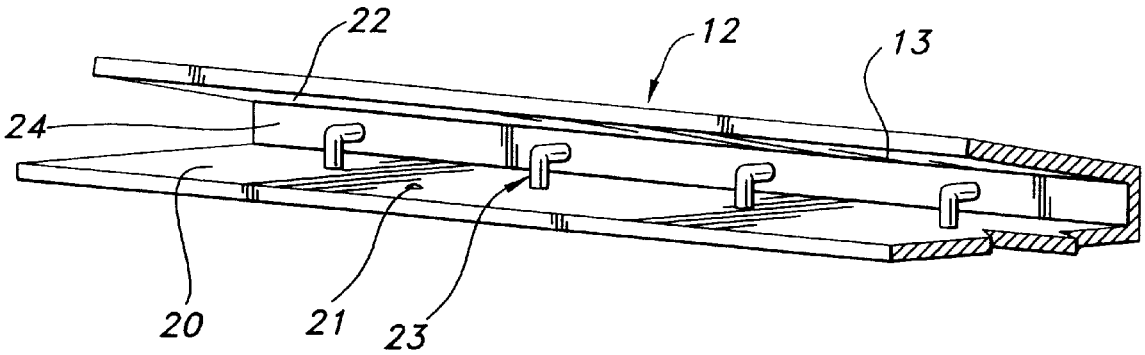
FIG. 3 is a front perspective view, partially cut away, of the inside of a securing strip in accordance with the present invention.

Referring now to FIGS. 3–4 of the drawings, a preferred embodiment of a securing strip 12 according to the invention is shown. Each securing strip 12 includes a base portion 20, a folding edge 22, and a bight 24 which interconnects the folding edge to the base portion. The folding edge 22 moves relative to base portion 20 in order to allow shingles to be placed on the securing strip. The bight 24 spaces the folding edge 22 upwardly away from the base portion 20 a sufficient distance so that a shingle 50 may be placed therebetween.

The folding edge 22 is pivotally attached to the hinge 13 at the top edge of the bight 24, so as to be pivotally movable thereon. Alternatively, the folding edge 22 may be integrally and fixedly attached to the top edge of the bight 24, and the hinge 13 may be placed at the bottom of the bight where it joins to the base portion 20. Each of the base portion 20 and the folding edge 22 is a generally flattened strip of material, which, as noted, may be aluminum or a strong weather-resistant plastic.

The securing strip 12 also includes a plurality of projecting members 23 which are attached to the base portion 20 in the depicted embodiment. The projecting members 23 extend from at least one of the base portion 20 and the folding edge 22. Preferably, the projecting members are attached to the base portion 20, as shown, to take advantage of the natural effect of gravity to help hold a shingle 50 in place thereon.

Figure 5:
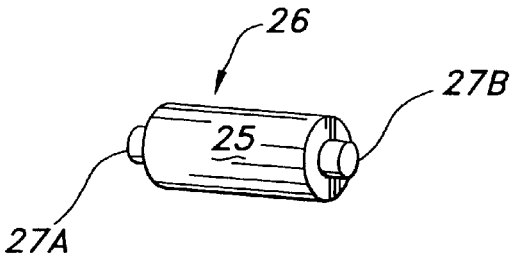
FIG. 5 is a detail perspective view of a pin usable for the projecting members in accordance with the present invention.
Figure 6:
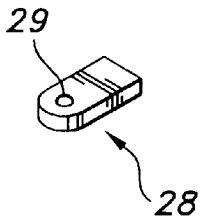
FIG. 6 is a detail perspective view of an end cap that attaches to the pin of FIG. 5 to comprise a projecting member in accordance with the present invention.
Figure 7:
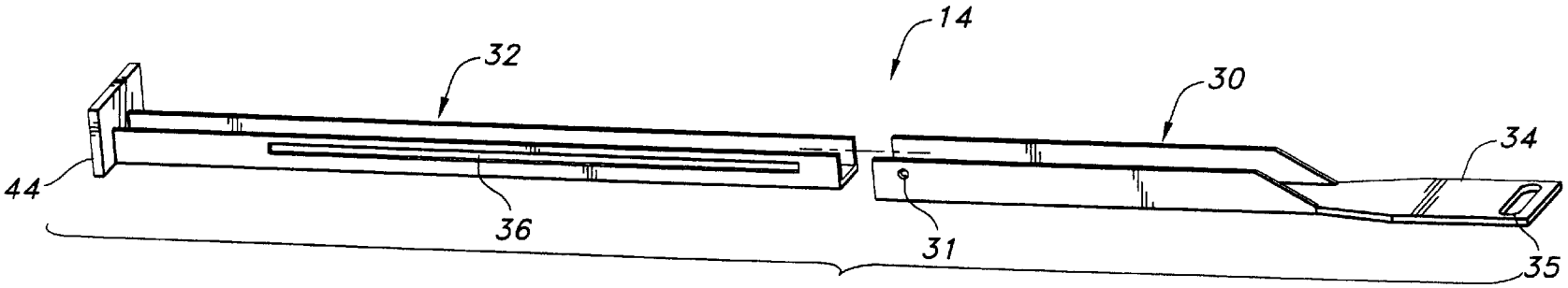
FIG 7 is a side perspective view of a adjustable spacer tool in accordance with the present invention, shown separated into two component pieces.
Figure 8:
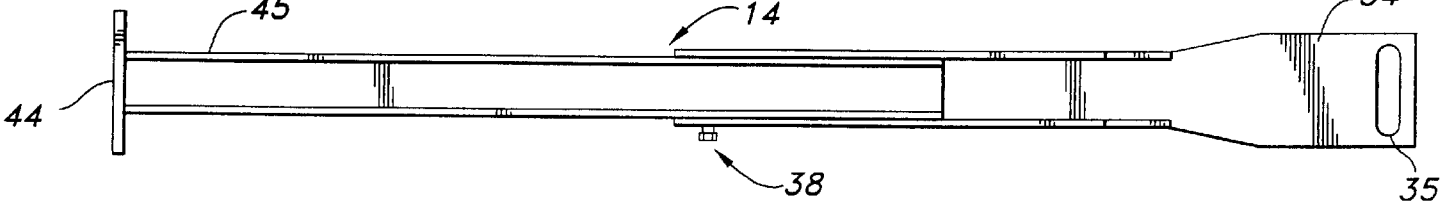
FIG 8 is a top plan view of the tool of FIG. 7, shown assembled.
Figure 9:
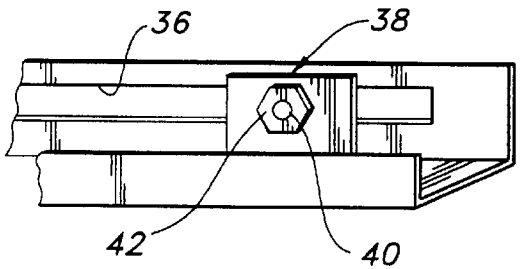
FIG. 9 is a detail perspective view, partially cut away, of an end portion of the inside piece of the adjustable spacer tool of FIG. 7, showing a locknut assembly thereon in accordance with the present invention.
Figure 10:
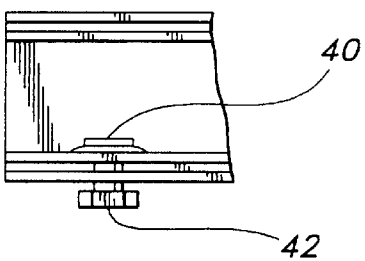
FIG. 10 is a detail top plan view of a connecting portion of the tool of FIG. 7.

Referring now to FIGS. 5–6, one possible preferred embodiment of a projecting member 23. for the securing strip 12, is shown. In the depicted embodiment, each projecting member 23 includes a pin 26 and an end cap 28.

The pin 26 includes a generally cylindrical body 25 and two narrowed diameter sections 27A, 27B at opposite ends thereof. A first narrowed diameter section 27A of the pin 26 is attached to the base portion 20 of the securing strip 12, and the end cap 28 is attached to the other narrowed diameter section 27B of the pin opposite the base portion. The end cap 28 is a substantially flattened member in the depicted embodiment, which is preferred to be wider than the diameter of the pin 26. The end cap has a hole 29 formed through one end thereof to receive a narrowed diameter section 27B of the pin therein. The end cap 28 is offset from the vertical central axis of the pin 26, forming a retaining flange 25 extending beyond the pin 26, toward the inside surface of the bight 24. The retaining flange 25 operates to retain a shingle 50 on the securing strip 12 until the shingle is temporarily fixed in place by the folding edge 22.

The pin 26 and end cap 28 may be made of aluminum, but could also be made from other suitable materials. The end cap 28 is preferably shaped as seen in FIG. 6, however, in order to simplify the manufacturing process, a standard round aluminum washer or similar object could be used for the end cap 28 instead of the shape shown in FIG. 6, without loss of functionality.

According to the embodiment shown in the drawings, each projecting member 23 is permanently attached to the base portion 20 of a securing strip 12. However, the projecting members 23 could also be made removable and/or replaceable from the strip 12 to increase functionality and/or simplify packaging and shipping, as long as the projecting members are securely attached to the securing strips when in place on the roof. For example, at the installation site, the projecting members 23 could be pressed into place through pre-punched holes in the strip 12, instead of the securing strip arriving with the projecting members permanently in place.

As another alternative embodiment of the securing strips 12, the strips could be integrally formed from injection molded plastic with the projecting members 23 also molded as part of the same integral piece. Pre-molded plastic securing strips of this type could be made in a continuous operation and could be formed into rolls of stock, to be cut to fit a particular job.

The above-described securing strips 12 enable attachment of shingles 50 to a surface, such as the roof R of FIG. 1. Each lateral row of shingles requires a securing strip 12, and each securing strip is covered over by the row of shingles above it, when installed.

According to the invention, each securing strip 12 provides two ways to attach it to the roof surface. One way of attachment is by a piece of adhesive material 90 (FIG. 4) which may be sticky tar material, double-sided tape or other adhesive on the bottom surface of the securing strip base portion 20. This adhesive would not only create a temporary bond initially to assist in placement of the strips on the roof, but would also create a strong bond with the roof surface from the heat of the sun. The second way of attaching the securing strips 12 to the roof R according to the invention, is by a plurality of shaped holes, such as that shown at 21, formed through the base portion 20 of each securing strip. These holes 21 allow attachment to the roof R by a fasteners such as nails. These are just two illustrations of possible fastening methods according to the invention, and other ways to fasten the securing strips to the roof surface could be used as needed to supplement or replace one or both of the specifically mentioned methods.

The Shingles

Referring now to FIG. 2, there is shown the preferred embodiment of the shingles 50. According to the invention, each shingle 50 has a plurality of spaced holes 52 formed through the top end thereof, to allow the shingle to be attached to the securing strip 12 with the projecting members 23 extending through the holes 52. Each hole 52 is shaped and sized such that it may be readily manipulated over the end cap 28 and onto the main body 25 pin 26, but is restricted from being displaced off the pin by the end cap. The end cap 28 operates to retain the shingle on the pins 26 until it is fixed in place by the folding edge 22, since gravity pushing down on the 20 shingle will not allow it to simply slide over and off the end cap. According to the invention, the shingles are conventional asphalt shingles with the necessary holes 52 punched through them.

The holes could be punched during the manufacturing process before packaging, or the shingles could be punched as a bundle before being placed on pallets, so only the required number of shingles are punched. Additionally, the lateral edge of each shingle is horizontally adjacent to any adjacent shingle and a natural bond occurs between the tar of each pair of abutting shingles to form a seal. Furthermore, according to the invention, each shingle used on the roof is the same, which makes installation simple.

Roofing Kit

The present invention also encompasses a roofing kit, which includes a plurality of shingles of the type herein described, the securing strips 12 as described, and at least two identical adjustable spacer tools as shown at 14, 16 in FIG. 1.

The Adjustable Spacer Tool

Referring now to FIGS. 7–10 there is shown an illustrative embodiment of an adjustable spacer tool 14. The second spacer tool 16 shown in FIG. 1 is substantially identical to the first tool 14 as described herein, and the tools are used in pairs to correctly space opposite ends of a securing strip 12. The tool 14 of FIGS. 7–10 includes two primary channeled pieces, an outside piece 30 and an inside piece 32, which fits nestingly and slidably inside the outside piece., Each of the channeled pieces 30, 32 is shaped substantially as a three-sided member with a cross-sectional squared off U-shape.

The outside piece 30 includes a hole 31 formed through a side section thereof on one end of the piece, which provides a way to attach the inside piece 32 to outside piece 30. The end of the outside piece 30 opposite the hole 31 carries a widened connector plate 34, which has a radius slot 35 formed therein. The radius slot 35 is shaped and sized to be readily manipulated over an end cap 28 of a projecting member 23, and on to the corresponding pin 26.

The inside piece 32 includes an elongated adjustment slot 36 formed therein along the side of the channel. A locknut assembly 38 includes a bolt 40 and a locking nut 42 for the bolt. The bolt 40 of the locknut assembly 38 fits through the hole 31 in the outside piece 30, and also fits through the adjustment slot 36 of the inside piece 32, which lines up in alignment with the hole 31 when the inside piece is nested into the outside piece. Once the bolt 40 is placed through the adjustment slot 36, the locking nut 42 is threaded thereon to adjustably attach the outside piece 30 to the inside piece 32. The inside piece 32 also includes a flattened end plate 44 transversely attached to the terminal end 45 thereof, opposite the adjusting slot 36.

According to the invention, the tool 14 is first adjusted to a preferred length. Then, the tool is abutted against a previously mounted securing strip with one or more projecting members 23 of a second securing strip protruding through the radius slot 35 of the tool 14 (FIG. 1). The end plate 44 at the bottom edge of the tool 14 then measures the placement of the securing strip 12 for the next row of shingles. The ability to adjust the length of the tool 14 via the locknut assembly 38 makes the tool versatile, enabling the tool to be used with various brands and sizes of shingles. Furthermore, the tool 14 is reusable on many roofing jobs.

Since the individual shingles 50 are not directly attached to the surface of the roof R, but are mounted on the securing strips 12 via the projecting members 23 thereof, it is relatively easy to remove and replace individual failed shingles at a later time, if that becomes necessary. All that is needed to replace a failed shingle is to lift up the shingle immediately above the failed shingle, to expose the securing strip 12 of the failed shingle. The folding edge 22 of the securing strip 12 holding the failed shingle is then folded back, and the shingle may then be lifted off of the projecting members and replaced by a new shingle.

Although the present invention has been described herein with respect to a preferred embodiment thereof, the foregoing description is intended to be illustrative, and not restrictive. Those skilled in the art will realize that many modifications of the preferred embodiment could be made which would be operable. All such modifications which are within the scope of the claims are intended to be within the scope and spirit of the present invention.

What is claimed is:

1. A shingle mounting system comprising:

a plurality of asphalt shingles; and shingle retaining means for detachably holding said shingles;

wherein said shingle retaining means includes a plurality of elongate securing strips for removably securing a plurality of said shingles thereto, each said securing strip being attachable to a roof surface and comprising a base portion and a folding edge which is operatively pivotally attached to the base portion and is pivotally movable with respect thereto;

each said securing strip being placeable in a shingle retaining orientation for retaining a shingle there against, and further being placeable in a shingle releasing orientation for allowing placement of a shingle thereon or removal of a shingle therefrom.

2. The shingle mounting system of claim 1, wherein said securing strips are formed of plastic.

3. The shingle mounting system of claim 2, wherein each of said securing strips comprises a living hinge.

4. A shingle mounting system as claimed in claim 1, wherein each of said securing strips is a continuous unitary member molded of aluminum.

5. A shingle mounting system as claimed in claim 1, wherein said securing strips include projecting members spaced there along, and each said shingle has a plurality of spaced holes formed through a top end thereof, such that said shingles may be attached to said securing strips with said projecting members extending through said holes in said shingles.

6. A shingle mounting system as claimed in claim 1, wherein each said securing strip includes a plurality of projecting members extending from at least one of said base portion and said folding edge, said projecting members being operable to engage and fix said shingles to said strip when said folding edge is moved adjacent to said base portion.

7. A shingle mounting system as claimed in claim 6, wherein each said projecting member comprises a pin, projecting from at least one of said base portion and said folding edge, and an end cap connected to said pin.

8. A shingle mounting system as claimed in claim 7, wherein each said end cap is operable to retain said shingle on said pin, said folding edge is operable to removably fix said shingle on said securing strip.

9. A shingle mounting system as claimed in claim 8, wherein said end cap is a substantially flattened member which is wider than said pin, to aid in retaining said shingle on said pin.

10. A shingle mounting system as claimed in claim 9, wherein each said hole of said shingle is dimensioned such that said shingle can be readily manipulated over said end cap onto said pin but resists displacement thereof off said end cap.

11. A shingle mounting system comprising:

a plurality of asphalt shingles, each of said shingles having a plurality of spaced apart holes formed therein proximate an upper edge thereof; and shingle retaining means for detachably holding said shingles; said shingle retaining means comprising a plurality of elongated securing strips, each of said securing strips comprising:

a flattened base portion which is a first elongated strip;

a plurality of spaced apart projecting members attached to the base portion and extending upwardly therefrom, each of the projecting members comprising a pin and an end cap attached to the pin and including a shingle retaining portion which extends laterally away from the pin;

a folding edge comprising a second elongated strip, the folding edge being operatively pivotally attached to the base portion and being pivotally movable with respect thereto.

12. A shingle installation and replacement kit comprising:

a plurality of asphalt shingles;

at least two adjustable spacer tools for measuring placement of securing strips on a roof surface; and shingle retaining means for detachably holding said shingles; said shingle retaining means comprising a plurality of elongated securing strips, each of said securing strips comprising:

a flattened base portion which is a first elongated strip;

a plurality of spaced apart projecting members attached to the base portion and extending upwardly therefrom, each of the projecting members comprising a pin and an end cap attached to the pin and including a shingle retaining portion which extends laterally away from the pin;

a folding edge comprising a second elongated strip, the folding edge being operatively pivotally attached to the base portion and being pivotally movable with respect thereto.

13. A shingle installation and replacement kit as claimed in claim 12, wherein each said adjustable spacer tool is comprised of two channeled pieces, an inside piece and an outside piece.

14. A shingle installation and replacement kit as claimed in claim 13, wherein said outside piece of said adjustable spacer tool includes a flattened end portion with a radius slot formed therein, for attaching said tool to one of said securing strips with at least one of said projecting members extending through said radius slot, said outside piece further having and a hole formed therein on opposite said radius slot for receiving a fastener therethrough to attach said outside piece to said inside piece.

15. A shingle installation and replacement kit as claimed in claim 13, wherein said adjustable spacer tool comprises a locknut assembly for attaching said outside piece to said inside piece to temporarily and disengageably fix the length of said tool.

16. A method of installing shingles on a roof of a building, comprising the steps of:

(a) attaching a first securing strip to a lower portion of a roof surface, the first securing strip comprising:

a flattened base portion which is a first elongated strip;

a plurality of spaced apart projecting members attached to the base portion and extending upwardly therefrom, each of the projecting members comprising a pin and an end cap attached to the pin and including a shingle retaining portion which extends laterally away from the pin;

a folding edge comprising a second elongated strip, the folding edge being operatively pivotally attached to the base portion and being pivotally movable with respect thereto;

(b) placing a shingle on the first securing strip by pushing a plurality of spaced apart holes formed in an upper edge of said shingle over a corresponding number of projecting members of said securing strip;

(c) folding the folding edge of the first securing strip in covering relation over the upper edge of the first shingle;

(d) spacing a second securing strip a predetermined distance above the first securing strip using a spacer tool, wherein the second securing strip is substantially identical to the first securing strip; and (e) attaching the second securing strip to the roof surface.

17. A shingle mounting system, comprising:

a plurality of asphalt shingles, each of said shingles having a plurality of spaced apart holes formed therein proximate an upper edge thereof; and a plurality of elongated securing strips for attaching to a roof surface and for retaining shingles thereon, each of said securing strips comprising:

a base portion which comprises a first elongated strip;

a folding edge comprising a second elongated strip, the folding edge being operatively pivotally attached to the base portion and being pivotally movable with respect thereto; and a plurality of spaced apart projecting members attached to either of the base portion or the folding edge and extending outwardly therefrom.

18. The shingle mounting system of claim 17, further comprising at least one spacing tool having a first end with an opening formed therein and a second end spaced away from the first end.

19. A securing strip apparatus for substantially permanent installation on a roof as part of a shingle mounting system, said apparatus comprising:

a flattened base portion which is a first elongated strip;

a folding edge which is operatively pivotally attached to the base portion and is pivotally movable with respect thereto; and a plurality of spaced apart projecting members attached to either of the base portion or the folding edge and extending outwardly therefrom;

wherein said folding edge is foldable over said base portion in a substantially flattened folded configuration of said apparatus, and wherein said apparatus is adapted to fit beneath an adjacent shingle when in said folded configuration thereof.

20. A method of installing shingles on a building roof, comprising the steps of:

(a) attaching a first securing strip to a lower portion of a roof surface, the first securing strip comprising:

a flattened base portion which is a first elongated strip;

a folding edge which is operatively pivotally attached to the base portion and is pivotally movable with respect thereto; and a plurality of spaced apart projecting members attached to either of the base portion or the folding edge and extending outwardly therefrom;

(b) placing a shingle on the first securing strip by pushing a plurality of spaced apart holes formed in an upper edge of said shingle over a plurality of projecting members of said securing strip;

(c) folding the folding edge of the first securing strip over the base portion;

(d) spacing a second securing strip a predetermined distance above the first securing strip, wherein the second securing strip is substantially identical to the first securing strip; and (e) attaching the second securing strip to the roof surface.

* * * * *

UNITED STATES PATENT AND TRADEMARK OFFICE

CERTIFICATE OF CORRECTION

PATENT NO. : 6,470,642 B1
DATED : October 29, 2002
INVENTOR(S) : Perry Lewis Eads It is certified that error appears in the above-identified patent and that said Letters Patent is hereby corrected as shown below:

Column 1,
Line 36, after “replacing” delete the period.
Line 45, change “singles” to -- shingles --.

Column 2,
Line 67, change “nails of” to -- nails or --.

Column 4,
Line 13, change “a adjustable” to -- an adjustable --.
Line 36, delete “of”.

Column 5,
Line 33, after “23” delete the period.
Line 47, change “pin therein” to -- pin 26 therein --.

Column 6,
Line 29, change “a fasteners” to -- fasteners --.
Line 48, delete “20”.

Column 7,
Line 9, after the period delete the comma.
Line 35, after “tool” insert -- 14 --.

Column 8,
Line 9, change “there” to -- there- --.
Line 22, change “there along” to -- therealong --.

UNITED STATES PATENT AND TRADEMARK OFFICE

CERTIFICATE OF CORRECTION

PATENT NO. : 6,470,642 B1
DATED : October 29, 2002
INVENTOR(S) : Perry Lewis Eads It is certified that error appears in the above-identified patent and that said Letters Patent is hereby corrected as shown below:

Column 9,
Line 33, change “and a hole” to -- a hole --; change “on opposite” to -- opposite --.

Signed and Sealed this

Twenty-ninth Day of April, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,470,642 B1
APPLICATION NO. : 09/631256
DATED : October 29, 2002
INVENTOR(S) : Perry Lewis Eads It is certified that error appears in the above-identified patent and that said Letters Patent is hereby corrected as shown below:

Column 1,
Line 39, after "replacing" delete the period.
Line 48, change "singles" to -- shingles --.

Column 2,
Line 67, change "nails of" to -- nails or --.

Column 4,
Line 13, change "a adjustable' to -- an adjustable --.
Line 36, delete "of".

Column 5,
Line 33, after "23" delete the period.
Line 47, change "pin therein" to -- pin 26 therein --.

Column 6,
Line 29, change "a fasteners" to -- fasteners --.
Line 48, delete "20".

Column 7,
Line 9, after the period delete the comma.
Line 35, after "tool" insert -- 14 --.

Column 8,
Line 9, change "there" to -- there- --.
Line 22, change "there along" to -- therealong --.

UNITED STATES PATENT AND TRADEMARK OFFICE

CERTIFICATE OF CORRECTION

PATENT NO. : 6,470,642 B1
APPLICATION NO. : 09/631256
DATED : October 29, 2002
INVENTOR(S) : Perry Lewis Eads It is certified that error appears in the above-identified patent and that said Letters Patent is hereby corrected as shown below:

Column 9,
Line 33, change “and a hole” to --a hole--; change “on opposite” to --opposite--.

Signed and Sealed this

Thirty-first Day of July, 2007

JON W. DUDAS
*Director of the United States Patent and Trademark Office*